US008097099B2

(12) United States Patent
Saitoh et al.

(10) Patent No.: US 8,097,099 B2
(45) Date of Patent: Jan. 17, 2012

(54) HIGH TOUGHNESS ABRASION RESISTANT STEEL WITH LITTLE CHANGE IN HARDNESS DURING USE AND METHOD OF PRODUCTION OF SAME

(75) Inventors: Naoki Saitoh, Tokai (JP); Tatsuya Kumagai, Tokai (JP); Katsumi Kurebayashi, Tokyo (JP); Hirohide Muraoka, Tokai (JP)

(73) Assignee: Nippon Steel Corporation, Tokyo (JP)

( * ) Notice: Subject to any disclaimer, the term of this patent is extended or adjusted under 35 U.S.C. 154(b) by 435 days.

(21) Appl. No.: 11/991,592

(22) PCT Filed: Aug. 18, 2006

(86) PCT No.: PCT/JP2006/316657

§ 371 (c)(1),
(2), (4) Date: Mar. 5, 2008

(87) PCT Pub. No.: WO2007/029515

PCT Pub. Date: Mar. 15, 2007

(65) Prior Publication Data

US 2010/0059150 A1 Mar. 11, 2010

(30) Foreign Application Priority Data

Sep. 9, 2005 (JP) ..... 2005-262297

(51) Int. Cl.
*C22C 38/22* (2006.01)
*C22C 38/54* (2006.01)

(52) U.S. Cl. ..... 148/334; 148/654; 420/106; 420/109

(58) Field of Classification Search ..... 420/106, 420/109; 148/334, 654
See application file for complete search history.

(56) References Cited

FOREIGN PATENT DOCUMENTS

| | | | |
|---|---|---|---|
| JP | 60-59019 | A | 4/1985 |
| JP | 63-317623 | | 12/1988 |
| JP | 1-149921 | A | 6/1989 |
| JP | 1-172514 | A | 7/1989 |
| JP | 9-118950 | A | 5/1997 |
| JP | 2001-049387 | | 2/2001 |
| JP | 2004-010996 | | 1/2004 |
| JP | 2005-179783 | | 7/2005 |

*Primary Examiner* — Deborah Yee
(74) *Attorney, Agent, or Firm* — Kenyon & Kenyon LLP

(57) ABSTRACT

The present invention provides an abrasion resistant steel having a hardness of HB400 to HB520, having little change of hardness during long term use, and superior in toughness, characterized by containing, by mass %, C: 0.21% to 0.30%, Si: 0.30 to 1.00%, Mn: 0.32 to 0.70%, P: 0.02% or less, S: 0.01% or less, Cr: 0.1 to 2.0%, Mo: 0.1 to 1.0%, B: 0.0003 to 0.0030%, Al: 0.01 to 0.1%, and N: 0.01% or less, further containing one or more of V: 0.01 to 0.1%, Nb: 0.005 to 0.05%, Ti: 0.005 to 0.03%, Ca: 0.0005 to 0.05%, Mg: 0.0005 to 0.05%, and REM: 0.001 to 0.1%, having a balance of Fe, and furthermore having an ingredient with an M value defined by the following formula (1) of −10 to 16:

$$M=26\times[Si]-40\times[Mn]-3\times[Cr]+36\times[Mo]+63\times[V] \quad (1)$$

8 Claims, 1 Drawing Sheet

HIGH TOUGHNESS ABRASION RESISTANT STEEL WITH LITTLE CHANGE IN HARDNESS DURING USE AND METHOD OF PRODUCTION OF SAME

TECHNICAL FIELD

The present invention relates to an abrasion resistant steel having the hardness of HB400 to HB520 required in construction machinery, industrial machinery, etc., having little change in hardness during use, and superior in toughness and to a method of production of the same.

BACKGROUND ART

Abrasion resistant steel, needless to say, is required to have abrasion resistance property stable over a long term and to be able to withstand long term use. For the various types of damage given from the environment during use of abrasion resistant steel, previous inventions have disclosed improvement in the delayed cracking resistance and hot cracking resistance and furthermore the low temperature toughness envisioning use at low temperatures etc.

For example, as art providing technology for production of steel plate superior in delayed fracture resistance by means of reducing the Mn (for example, see Japanese Patent Publication (A) No. 60-59019) and furthermore the art of applying a method of treatment tempering the steel at a low temperature of 200 to 500° C. (for example, Japanese Patent Publication (A) No. 63-317623) have been reported.

For the purpose of providing steel superior in hot cracking resistance, the technology of production limiting the Mn, Cr, Mo, and other ingredients (for example, see Japanese Patent Publication (A) No. 1-172514) and, furthermore, as technology for production of steel superior in low temperature toughness, the technology of mainly using alloy elements and limiting these ingredients (see, for example, Japanese Patent Publication (A) No. 2001-49387, Japanese Patent Publication (A) No. 2005-179783, and Japanese Patent Publication (A) No. 2004-10996) have been disclosed.

The above inventions are superior inventions in line with their objectives, but no invention can be found at present able to maintain a hardness stable over a long period of time, the most basic property expected from general abrasion resistant steel, that is, taking note of the change of hardness of a material used for a long period at close to room temperature.

DISCLOSURE OF THE INVENTION

In recent years, due to the social demands for energy saving and resource saving, long term stability is being sought for the abrasion resistance, corrosion resistance, and other properties required for maintaining the performance of the material over a long time. In particular, abrasion resistant steel is used in various abrasive environments, but even in environments of use at room temperature, it is known that the abrasive surface is exposed to room temperature to 100° C. or so over a long period of time due to the heat of abrasion. However, the change in the properties of abrasion resistant steel in a temperature region slightly higher than room temperature in this way, in particular the hardness, has not been investigated much at all. The present invention has as its object the provision of a high toughness abrasion resistant steel with little change in hardness during long term use under this environment and a method of production of the same.

The present invention was made to solve this problem and provide the necessary technology for maintaining a hardness stable over a long period of time in abrasion resistant steel and has as its framework:

(1) A high toughness abrasion resistant steel with little change in hardness during use characterized by containing, by mass %, C: 0.21% to 0.30%, Si: 0.30 to 1.00%, Mn: 0.32 to 0.70%, P: 0.02% or less, S: 0.01% or less, Cr: 0.1 to 2.0%, Mo: 0.1 to 1.0%, B: 0.0003 to 0.0030%, Al: 0.01 to 0.1%, and N: 0.01% or less, having a balance of unavoidable impurities and Fe, and furthermore having an ingredient with an M value defined by the following formula (I) of M: −10 to 16:

$$M=26\times[Si]-f40\times[Mn]-3\times[Cr]+36\times[Mo]+63\times[V] \quad (1)$$

(2) A high toughness abrasion resistant steel with little change in hardness during use as set forth in the above (1), characterized by further containing one or more of V: 0.01 to 0.1%, Nb: 0.005 to 0.05%, Ti: 0.005 to 0.03%, Ca: 0.0005 to 0.05%, Mg: 0.0005 to 0.05%, and REM: 0.001 to 0.1%.

(3) A method of production of high toughness abrasion resistant steel plate with little change in hardness during use characterized by hot rolling steel having the chemical ingredients as set forth in the above (1) or (2), then quenching it from a temperature of the $Ac_3$ point or more.

(4) A method of production of high toughness abrasion resistant steel plate with little change in hardness during use characterized by heating steel having the chemical ingredients as set forth in the above (1) or (2) to 1000° C. to 1270° C., then hot rolling it at a temperature of 850° C. or more, then after finishing it immediately quenching the steel.

The present invention discovered the range of ingredients for preventing a change in hardness during long term use and the M value serving as an indicator in alloy design in abrasion resistant steel used in general at room temperature and thereby can provide steel plate able to remarkably improve the abrasion life.

BEST MODE FOR CARRYING OUT THE INVENTION

Figure 1:
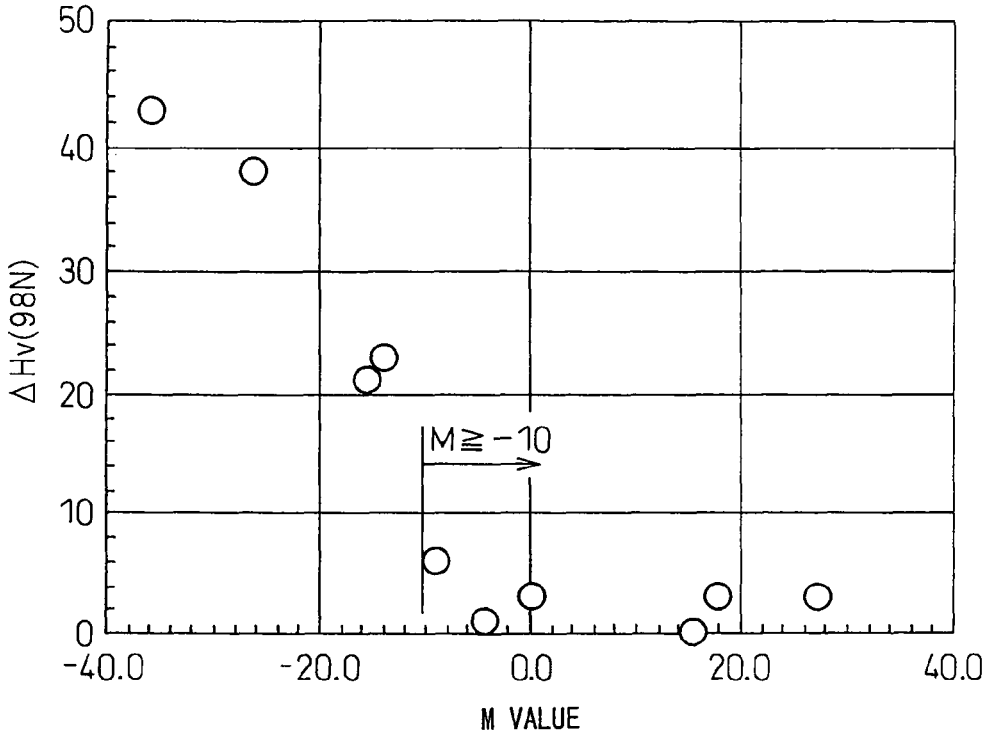
FIG. 1 is a view showing the effects of alloy elements on changes in hardness after holding at 150° C. for 10 hours.

In carrying out the present invention, designation of the amounts of addition of alloy elements is extremely important for the hardness and toughness of an abrasion resistant steel material. First, the reasons for defining the steel ingredients in the present invention will be explained.

C: This is the most important element for improving the hardness. To secure the quenched hardness, addition of 0.21% or more is necessary, but if over 0.30%, the hardness becomes too high and the hydrogen cracking resistance is remarkably impaired, so the upper limit is made 0.30%.

Si: This is effective as a deoxidizing material and an element suppressing a drop in hardness during use. With addition of 0.30% or more, a remarkable effect is observed, but if over 1.00% is added, the toughness is liable to be impaired, so 1.00% or less is made the upper limit.

Mn: This element is effective mainly for raising the hardenability. 0.32% or more is necessary. It promotes the formation of cementite in the martensite at a low temperature, so acts to drop in hardness during use. Addition of a large amount is not desirable, so the range is made 0.32% to 0.70%.

P: If this is present in a large amount, it causes the toughness to drop, so the less the better. The upper limit of content is made 0.02%. The content unavoidably included should be reduced as much as possible.

S: If present in a large amount, this cause the toughness to drop, so the smaller the amount the better. The upper limit of the content is made 0.01%. S, like P, should be reduced as much as possible as an unavoidable inclusion.

Cr: This is an element improving the hardenability. Addition of 0.1% or more is necessary, but if a large amount is added, the toughness is liable to be reduced, so the upper limit is made 2.0% or less.

Mo: This acts to improve the hardenability and simultaneously suppresses any change of hardness while being used for a long period of time. Addition of 0.1% or more is required, but if over 1.0% is added, the toughness is liable to be impaired, so the upper limit is made 1.0%.

B: This element suppresses the formation of ferrites and remarkably improves the hardenability. Addition of 0.0003% or more is needed. With addition over 0.0030%, boron compounds are produced and conversely the hardenability tends to fall, so the upper limit is made 0.003%.

Al: This is added as a deoxidizing element into the steel. 0.01% or more is necessary, but addition over 0.1% tends to obstruct the toughness, so the upper limit is made 0.1%.

N: If this is added in a large amount into steel, it causes the toughness to drop, so the less the better. The upper limit of content is made 0.01% or less.

The above were the basic ingredients of the present invention, but the present invention may further have added to it V, Nb, and Ti as elements improving the hardness and toughness of the matrix material and one or more of Ca, Mg, and REMs for the purpose of improvement of ductility and toughness.

V: This element improves the hardenability and contributes to improvement of the hardness. Addition of 0.01% or more is necessary, but excessive addition impairs the toughness, so the upper limit is made 0.1%.

Nb and Ti: These are elements which can improve the toughness by increasing the fineness of the crystal grains of the matrix material. An effect is obtained with addition of 0.005% of either of these, but remarkable addition is liable to impair the toughness through the formation of carbonitrides or other coarse precipitates, so the amounts of addition are made the ranges of Nb: 0.005 to 0.05% and Ti: 0.005 to 0.03%.

Ca, Mg, and REMs: These elements are effective as elements preventing a drop in ductility due to the stretching of the sulfides during the hot rolling. Ca and Mg exhibit this effect when added in amounts of 0.0005% or more, while REMs exhibit this effect when added in amounts of 0.001% or more, but excessive addition may cause coarsening of the sulfides and simultaneously formation of coarse oxides at the time of melting. Therefore, the ranges of addition are Ca: 0.0005 to 0.05%, Mg: 0.0005 to 0.05%, and REMs: 0.001 to 0.1%.

Based on the above ranges of ingredients, the present invention further uses the following formula (I) to limit the range of the M value:

$$M=26\times[Si]-40\times[Mn]-3\times[Cr]+36\times[Mo]+63\times[V] \quad (1)$$

The inventors engaged in numerous experiments and as a result clarified that in abrasion resistant steel, the change in hardness in the case of being held at room temperature to near 100° C. for a long period of time depends in large part on the alloy elements. FIG. 1 plots the difference between the hardness after quenching the hot rolled steel plate, which contains; 0.23-0.26% C–0.20-0.80% Si–0.35-1.23% Mn–0.45-1% Cr–0.2-0.5% Mo–0-0.105% V having plate thickness of 25 mm, and the hardness after holding this at 150° C. for 10 hours on the ordinate, and plots the M value calculated from the amount of the alloy elements on the abscissa. Holding at 150° C. for 10 hours corresponds to an acceleration test in the case of holding the steel at a temperature of room temperature to 100° C. or so for a long period of time. As will be understood from the results, the change in hardness (ΔHv) depends on the value of the M value. It is learned that if the M value exceeds −10, the ΔHv becomes 7 or less and almost no drop in hardness can be observed any longer.

Figure 2:
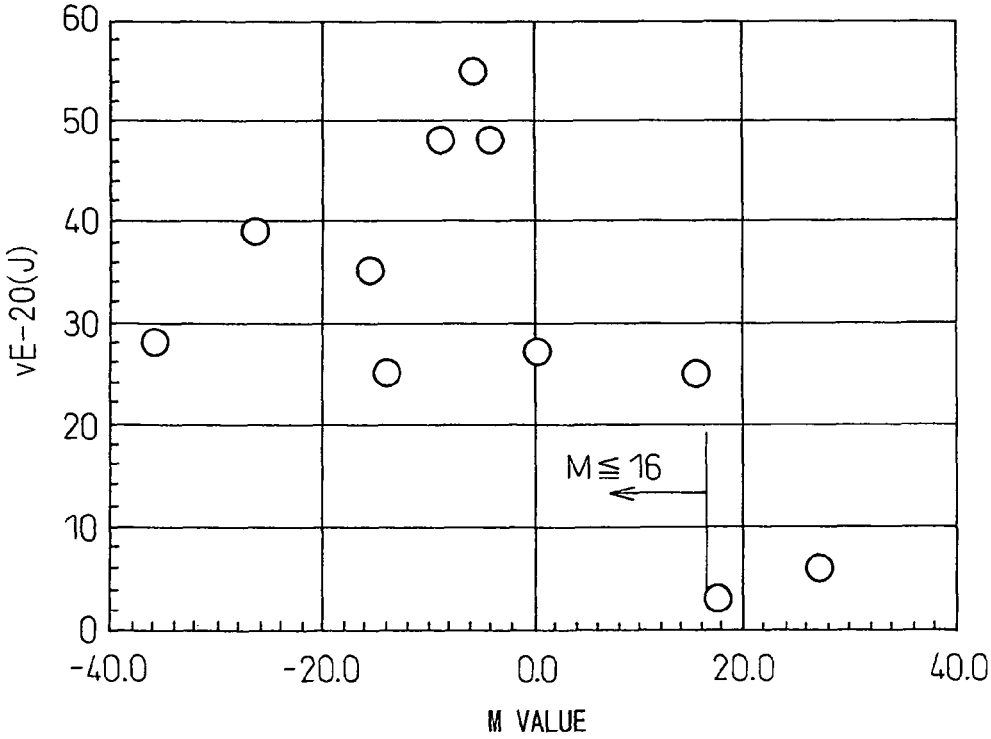
FIG. 2 is a view showing the effects of alloy elements on the Charpy absorption energy at −20° C. after holding at 150° C. for 10 hours.

Furthermore, FIG. 2 shows the Charpy absorption energy value at −20° C. at that time on the ordinate. As clear from this drawing, if the M value is over 16, a tendency for a drop in toughness is recognized.

From the above experimental facts, the inventors thought that it would be possible to provide technology for production of abrasion resistant steel with little change in hardness and a good toughness and, as shown in FIG. 1 and FIG. 2, limited the range to −10 to 16 to obtain the targeted properties of the present invention from the change in hardness in the case of holding the steel at a temperature of room temperature to 100° C. for a long period of time and the effect of the M value with respect to the toughness value.

The steel according to the present invention can be particularly suitably used for bucket members of power shovels or vessel members of dump trucks. If used for these members, since the hardness will not be reduced during long term use, the abrasion of the member will be remarkably reduced over the long term and the usage life can be improved at least 1.4-fold.

In the method of the present invention, a steel slab having the above ingredients is used as a starting material and is heated, rolled, and heat treated. The steel slab is produced by adjusting and melting the ingredients in a converter or electric furnace, then casting them by the continuous casting method or ingot-casting and blooming method etc.

Next, the steel slab is heated, then hot rolled to the target plate thickness, then reheated to a temperature of the $Ac_3$ point or more, then quenched. At this time, the heating temperature and rolling conditions of the steel slab and the conditions at the time of quenching may be the usually generally used conditions.

Further, instead of the reheating and quenching of the steel plate, it is also possible to heat, roll, then immediately directly quench the steel slab. The heating temperature of the steel slab at this time is 1000° C. to 1250° C. If the finishing temperature at the time of hot rolling is 850° C. or more, there is no problem with the properties after direct quenching. Regarding the limits on the heating temperature of the steel slab, if less than 1000° C., the alloy elements included will not solubilize and a drop in hardness is liable to be caused, while if a temperature over 1270° C., the old austenite crystal grains will become coarser at the time of heating and the toughness is liable to fall, so this condition was set.

On the other hand, the limits on the finishing temperature at the time of hot rolling were provided so as to secure the temperature at the time of direct quenching performed thereafter. If the finish rolling temperature becomes less than 850° C., the hardness after direct quenching is liable to fall, so a temperature of 850° C. or more is made the lower limit of the finishing temperature.

EXAMPLES

Table 1 shows the chemical ingredients of test steels produced as examples of the present invention. The test steels were produced as steel materials by the ingot-casting and blooming method or the continuous casting method. In the table, the Steels A to I have the chemical ingredients in the scope of the present invention, while the Steels J to P were ones produced outside the scope of chemical ingredients of the present invention.

The steel slabs shown in Table 1 were heated and hot rolled under the production conditions shown in Table 2, with some heat treated, to produce steel plates having plate thicknesses of 25 to 50 mm. After this, the plates were measured for Brinell hardness 0.5 mm right under the surface layer parts. Furthermore, parts of the steel plates were cut out, heat treated at 150° C. for 10 hours, then measured for Brinell hardness (HB) at the part 0.5 mm below the surfaces of the steel plates. Further, Charpy test pieces were taken (in longitudinal direction of rolling) from parts of ¼t of the plate thicknesses and tested at −20° C. The results are shown in Table 2.

In Table 2, the Steel 1 to the Steel 9 are inside the scope of the present invention. Under each of the conditions, it is learned that the hardness under the surface is in the range of HB400 to HB520 and that the drop in hardness during long term use is HB10 or less or extremely small. Furthermore, toughnesses of values of all 21J or more at −20° C. are exhibited.

As opposed to this, the Steel 10 to Steel 18 are cases where one of the chemical ingredients or production conditions of the steel plate is outside the scope of the present invention.

First, the Steel 10 to Steel 16 are cases where the chemical ingredients are outside the scope of the present invention. That is, the Steel 10 and Steel 11 have amounts of C outside the scope of the present invention. As a result, the Steel 11 is the case where the amount of C is 0.19% or lower than the scope of the present invention, but the matrix material falls in hardness to HB382. On the other hand, the Steel 11 is the case where conversely the amount of C is higher than the scope, but the matrix material remarkably rises in hardness to HB563 and is also low in toughness.

The Steel 12 is an example where the amount of addition of Si is higher than the scope of the present invention. In this case, the hardness of the matrix material rises and as a result the toughness becomes low.

The Steel 13 is an example where the amount of addition of Mn is higher than the scope of the present invention. As a result, the change in hardness ΔHB becomes a somewhat large 15 or so and is low in toughness.

The Steels 14 and 15 have high amounts of Cr and Mo outside the scope of the present invention. In this case, the change in hardness ΔHB is small, but the toughness is remarkably low.

The Steel 16 is the case where the M value is outside the scope of the present invention. In this case, the toughness is good, but the change in hardness ΔHB becomes an extremely large 31.

The Steel 17 and Steel 18 are cases produced under conditions outside the scope of the present invention in the scope of ingredients and production conditions. That is, the Steels 17 and 18 have ingredient systems with amounts of Mn higher than the scope of the invention, the Steel 17 is the case of heating with a quenching temperature after rolling of the $Ac_3$ transformation point or less, while the Steel 18 is the case where the finish rolling temperature is lower than the 850° C. or more of the scope of the present invention in the direct quenching process. Each has a hardness of the matrix material of HB400 or less and does not have the target hardness.

TABLE 1

| Steel type | | Chemical ingredients C | Si | Mn | P (mass %) | S | Cr | Mo | Al | N (ppm) | B | V | Nb (mass %) | Ti | Ca (ppm) | Mg | REM | $Ar_3$ (° C.) | M value |
|---|---|---|---|---|---|---|---|---|---|---|---|---|---|---|---|---|---|---|---|
| Present invention | A | 0.25 | 0.35 | 0.58 | 0.012 | 0.005 | 0.85 | 0.21 | 0.048 | 45 | 12 | | | | | | | 830 | −9.1 |
| | B | 0.28 | 0.85 | 0.45 | 0.012 | 0.005 | 0.26 | 0.15 | 0.057 | 42 | 15 | | | | 11 | | | 847 | 8.7 |
| | C | 0.23 | 0.41 | 0.55 | 0.008 | 0.002 | 0.55 | 0.15 | 0.048 | 35 | 12 | 0.049 | | | | | | 849 | −4.5 |
| | D | 0.26 | 0.35 | 0.52 | 0.007 | 0.003 | 0.85 | 0.21 | 0.035 | 48 | 11 | | 0.018 | | | | | 826 | −6.7 |
| | E | 0.25 | 0.35 | 0.59 | 0.003 | 0.001 | 0.49 | 0.28 | 0.026 | 43 | 10 | | | 0.015 | | | | 834 | −5.9 |
| | F | 0.25 | 0.85 | 0.63 | 0.002 | 0.002 | 0.88 | 0.23 | 0.036 | 35 | 12 | 0.082 | 0.015 | 0.013 | | | | 868 | 7.7 |
| | G | 0.28 | 0.46 | 0.35 | 0.011 | 0.002 | 0.62 | 0.32 | 0.029 | 52 | 15 | | | 0.012 | 12 | | | 832 | 7.6 |
| | H | 0.25 | 0.52 | 0.46 | 0.004 | 0.001 | 0.95 | 0.36 | 0.032 | 45 | 12 | 0.023 | | 0.014 | | 12 | | 850 | 6.7 |
| | I | 0.24 | 0.93 | 0.64 | 0.003 | 0.001 | 0.95 | 0.36 | 0.065 | 35 | 12 | 0.095 | | | | | 23 | 883 | 14.7 |
| Comparative example | J | 0.19 | 0.33 | 0.55 | 0.008 | 0.002 | 0.52 | 0.21 | 0.049 | 33 | 10 | | | | | | | 860 | −7.4 |
| | K | 0.35 | 0.36 | 0.59 | 0.003 | 0.002 | 0.59 | 0.19 | 0.035 | 48 | 12 | | 0.015 | | | | | 783 | −9.2 |
| | L | 0.23 | 1.12 | 0.45 | 0.003 | 0.004 | 0.77 | 0.15 | 0.035 | 48 | 10 | | | 0.012 | | | | 883 | 14.2 |
| | M | 0.24 | 0.41 | 0.92 | 0.002 | 0.001 | 0.92 | 0.45 | 0.065 | 44 | 15 | 0.075 | 0.014 | | | | | 849 | −8.0 |
| | N | 0.25 | 0.47 | 0.55 | 0.008 | 0.001 | 2.32 | 0.21 | 0.035 | 48 | 12 | | 0.021 | 0.013 | | | | 830 | −9.2 |
| | O | 0.28 | 0.32 | 0.65 | 0.002 | 0.002 | 0.45 | 1.12 | 0.062 | 42 | 10 | | | | | | | 849 | 21.3 |
| | P | 0.27 | 0.25 | 0.65 | 0.003 | 0.001 | 0.95 | 0.21 | 0.048 | 35 | 12 | | | | | | | 813 | −14.8 |

Underlines indicate outside scope of the present invention.

TABLE 2

| No. | Steel type | Manufacturing conditions: Heating temp. (° C.) | Rolling finishing temp. (° C.) | Quenching temp. (° C.) | Direct quenching | Plate thickness (mm) | Test results: Hardness HB under surface of matrix material (A) | Hardness HB after holding at 150° C. for 10 hours (B) | ΔHB (A) − (B) | vE-20 (J) | Remarks |
|---|---|---|---|---|---|---|---|---|---|---|---|
| 1 | A | 1150 | 932 | 920 | — | 25 | 477 | 470 | 7 | | Present |
| 2 | B | 1150 | 965 | 910 | — | 50 | 515 | 512 | 3 | 28 | invention |

TABLE 2-continued

| No. | Steel type | Manufacturing conditions: Heating temp. (° C.) | Rolling finishing temp. (° C.) | Quenching temp. (° C.) | Direct quenching | Plate thickness (mm) | Test results: Hardness HB under surface of matrix material (A) | Hardness HB after holding at 150° C. for 10 hours (B) | ΔHB (A) − (B) | vE-20 (J) | Remarks |
|---|---|---|---|---|---|---|---|---|---|---|---|
| 3 | C | 1150 | 925 | 920 | — | 25 | 443 | 440 | 3 | 38 | |
| 4 | D | 1150 | 938 | 910 | — | 25 | 482 | 481 | 1 | 36 | |
| 5 | E | 1150 | 941 | 920 | — | 25 | 479 | 477 | 2 | 45 | |
| 6 | F | 1100 | 935 | | ○ | 25 | 485 | 483 | 2 | 29 | |
| 7 | G | 1150 | 942 | 920 | — | 35 | 518 | 512 | 6 | 21 | |
| 8 | H | 1100 | 920 | | ○ | 25 | 488 | 485 | 3 | 25 | |
| 9 | I | 1150 | 918 | 920 | — | 50 | 456 | 453 | 3 | 22 | |
| 10 | J | 1150 | 942 | 920 | — | 25 | 382 | 375 | 7 | 59 | Comparative steel |
| 11 | K | 1150 | 952 | 920 | — | 25 | 563 | 553 | 10 | 5 | |
| 12 | L | 1150 | 950 | | ○ | 25 | 519 | 518 | 1 | 12 | |
| 13 | M | 1150 | 932 | 920 | — | 25 | 465 | 450 | 15 | 17 | |
| 14 | N | 1150 | 940 | 920 | — | 25 | 482 | 477 | 5 | 9 | |
| 15 | O | 1150 | 953 | 920 | — | 50 | 511 | 510 | 1 | 8 | |
| 16 | P | 1150 | 960 | 920 | — | 25 | 465 | 465 | 31 | 44 | |
| 17 | N | 1150 | 932 | 820 | — | 25 | 341 | 320 | 21 | 20 | |
| 18 | N | 1150 | 826 | | ○ | 25 | 371 | 363 | 8 | 25 | |

Underlines indicate outside scope of the present invention.

INDUSTRIAL APPLICABILITY

The present invention enables a remarkable reduction in the change in hardness during use—extremely important in the characteristics of abrasion resistant steel.

The invention claimed is:

1. A high toughness abrasion resistant steel with little change in hardness during use characterized by containing, by mass %, C: 0.21% to 0.30%,
Si: 0.52% to 1.00%,
Mn: over 0.45 to 0.64%,
P: 0.02% or less,
S: 0.005% or less,
Cr: 0.1 to 2.0%,
Mo: 0.1 to 1.0%,
B: 0.0003 to 0.0030%,
Al: 0.01 to 0.1%, and
N: 0.01% or less, having a balance of unavoidable impurities and Fe, and furthermore having an ingredient with an M value defined by the following formula (1) of M: −10 to 16:

$$M=26\times[Si]-40\times[Mn]-3\times[Cr]+36\times[Mo]+63\times[V] \quad (1).$$

2. A high toughness abrasion resistant steel with little change in hardness during use as set forth in claim 1, characterized by further containing one or more of:

V: 0.01 to 0.1%,
Nb: 0.005 to 0.05%,
Ti: 0.005 to 0.03%,
Mg: 0.0005 to 0.05%, and
REM: 0.001 to 0.1%.

3. A method of production of high toughness abrasion resistant steel plate with little change in hardness during use characterized by hot rolling steel having the chemical ingredients as set forth in claim 1 or 2, then quenching it from a temperature of the $Ac_3$ point or more.

4. A method of production of high toughness abrasion resistant steel plate with little change in hardness during use characterized by heating steel having the chemical ingredients as set forth in claims 1 or 2 to 1000° C. to 1270° C., then hot rolling it at a temperature of 850° C. or more, then after finishing it immediately quenching the steel.

5. The high toughness abrasion resistant steel of claim 1 or 2, wherein the steel contains Cr: 0.1 to 0.95%.

6. The high toughness abrasion resistant steel of claim 1 or 2, wherein S is in an amount of 0.002% or less.

7. The high toughness abrasion resistant steel of claim 1 or 2, wherein the Charpy impact toughness at −20° C. is 21 J or higher.

8. The high toughness abrasion resistant steel of claim 6, wherein Ca is not added.

* * * * *